United States Patent [19]

Snyder et al.

[11] Patent Number: 4,750,944

[45] Date of Patent: Jun. 14, 1988

[54] LAVES FREE CAST+HIP NICKEL BASE SUPERALLOY

[75] Inventors: Sherman M. Snyder, West Hartford; Edgar E. Brown, South Windsor, both of Conn.

[73] Assignee: United Technologies Corporation, Hartford, Conn.

[21] Appl. No.: 814,704

[22] Filed: Dec. 30, 1985

[51] Int. Cl.[4] ..... C22F 1/10

[52] U.S. Cl. ..... 148/2; 148/3; 148/11.5 N; 148/12.7 N; 148/127; 148/410; 148/428

[58] Field of Search ..... 420/448; 148/11.5 N, 148/12.7 N, 127, 410, 428, 2, 3

[56] References Cited

U.S. PATENT DOCUMENTS 3,046,108 7/1962 Eiselstein ..... 420/448

OTHER PUBLICATIONS

R. Vincent, "Precipitation Around Welds in the Nickel-Base Superalloy, Inconel 718", Acta Metallurgica, vol. 33, No. 7, pp. 1205-1216 (1985).

R. C. Hall, "The Metallurgy of Alloy 718," Journal of Basic Engineering, pp. 511-516 (Sep. 1967).

H. L. Eiselstein, "Metallurgy of a Columbium-Hardened Nickel-Chromium-Iron Alloy", American Society for Testing and Materials, Special Technical Publication No. 369, Advances in the Technology of Stainless Steels and Related Alloys, Philadelphia, Apr. 1965.

H. J. Wagner and A. M. Hall, "Physical Metallurgy of Alloy 718", Defense Metal Information Center Report 217, Battelle Memorial Institute, Columbus, Jun. 1, 1965.

*Primary Examiner*—R. Dean

*Attorney, Agent, or Firm*—James M. Rashid

[57] ABSTRACT

A nickel base superalloy composition useful in the cast+HIP+heat treated condition is described. Articles having the invention composition have properties which are comparable to similarly processed IN718 articles. The invention alloys have an as-cast microstructure which is substantially free from Laves phase, even at slow solidification rates. As a result, the alloys are significantly more weldable than IN718. This desirable microstructure is achieved by modifications of the chromium, molybdenum, iron, and nickel contents compared to the typical IN718 composition.

9 Claims, 7 Drawing Sheets

FIG. 3
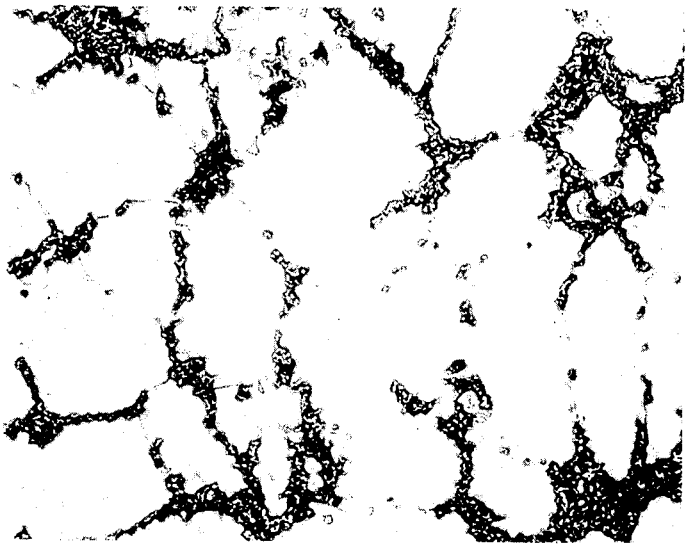
100 X
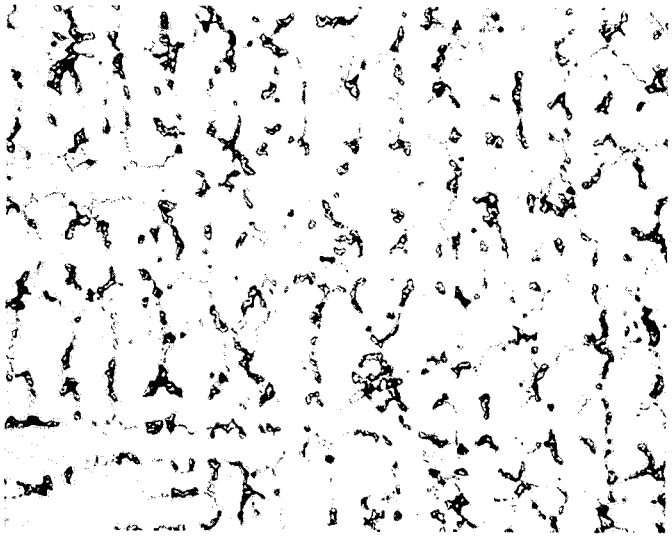
FIG. 4
100 X

LAVES FREE CAST+HIP NICKEL BASE SUPERALLOY

CROSS REFERENCE

The invention described in this application is related to the invention described in the copending, commonly assigned application, HIGH STRENGTH CAST+HIP NICKEL BASE SUPERALLOY, Ser. No. 814,695 filed by S. M. Snyder and E. E. Brown on the same day as this application was filed.

TECHNICAL FIELD

This invention relates to cast nickel base superalloys, and in particular to compositions useful in casting large structural components for use in turbine engines.

BACKGROUND ART

Superalloys are nickel, cobalt, or iron base materials, and have useful mechanical properties at temperatures on the order of 1,000° F. and above. Because of their desirable properties, superalloys have found numerous applications in gas turbine engines. In general, components for gas turbine engines are either cast, fabricated by powder metallurgy techniques, or are fabricated and machined from thermo-mechanically worked product forms such as forgings, plate, and sheet. Thermo-mechanically worked products usually have a finer grain size and more homogeneous microstructure than castings of the same alloy. As a result, their mechanical properties are typically better than those of castings. While the fabrication and machining of components from various thermo-mechanically worked product forms is possible, the process is labor intensive and produces much scrap. For these reasons, it is quite expensive, and casting is a preferred process. Castings are sometimes hot isostatically pressed (HIP'd) to enhance properties.

The well known nickel base superalloy INCONEL ® Alloy 718 has been used by the gas turbine engine industry for many years. INCONEL is a registered trademark of The International Nickel Company, Inc. Hereinafter, INCONEL Alloy 718 will be referred to as IN718. This alloy is described in Aerospace Materials Specifications (AMS) 5663 (wrought products) and AMS 5383 (cast products). According to AMS 5383, the composition range for IN718 is, by weight percent, 50–55 Ni, 17–21 Cr, 4.75–5.5 Cb+Ta, 2.8–3.3 Mo, 0–1 Co, 0.65–1.15 Ti, 0.4–0.8 Al, 0.0–1.75 Al+Ti, 0.0–0.35 Si, 0.0–0.006 B, 0.0–0.30 Cu, 0.0–0.015 S, 0.0–0.015 P, 0.0–0.35 Mn, 0.0–0.10 C, with the balance Fe. As shown in Table I, IN718 in wrought form has better mechanical properties than the alloy in cast+HIP form. In the Table, wrought IN718 specimens were processed into bars and forgings according to AMS 5663 requirements. Cast+HIP IN718 specimens were HIP'd at 2,175° F. for 4 hours at 15,000 pounds per square inch (psi) in argon and then heat treated to optimize mechanical properties.

The desirability of casting large, complex IN718 components to near-net shape which require a minimum of post-casting processing has long been apparent. Such a capability would substantially decrease the ultimate cost of the component due to the elimination of forging, machining, and joining operations.

A development program was conducted to examine the possibility of casting IN718 into large structural components for turbomachinery such as gas turbine engines. After solving many casting related problems, it was noticed that porosity, segregation, and inclusions were still present in the castings to undesirable levels. Such defects are detrimental to mechanical properties, and must be eliminated if the use of large IN718 cast components is to become practicable. In order to reduce the porosity and segregation, the castings were given a hot isostatic pressing treatment, which was found to reduce the number of some of these defects. Following the HIP treatment, attempts were made to weld repair remaining casting defects; weld repair of such defects by e.g., gas tungsten arc or gas metal arc welding techniques is well known in the art. However, during the repair of these defects, difficulty was encountered. This difficulty was evidenced in the form of substantial outgassing and weld splatter which was generated during the repair process. Additionally, metallographic examination of the welds indicated an unacceptable and abnormal quantity of gas holes in the weld, the holes shown by arrows in FIG. 1; microcracks in the heat affected zone (HAZ) (shown by arrows in FIG. 2) were also detected. After a detailed investigation, it was found that the difficulties encountered during weld repair, and the gas holes in the weld were the result of entrapment of the high pressure HIP media (argon gas) during the HIP treatment in pores connected to the surface either directly or by way of grain boundaries. The gas entrapment apparently resulted when localized melting of the component occurred during the elevated temperature HIP treatment. Gas that had penetrated into the component by way of surface connected porosity or liquated grain boundaries was trapped as the locally melted material dissolved into the matrix by thermal homogenization during the HIP treatment, and as the component cooled to room temperature at the conclusion of the HIP treatment. Metallographic studies indicated an unusually large amount of the low melting Laves phase in the same areas that gas entrapment was found. In IN718, the Laves phase is believed to have the general formula $(Ni, Fe, Cr, Mn, Si)_2(Mo, Ti, Cb)$.

Laves phase was also found to be the primary cause of the observed HAZ microcracking, although it was determined that such cracking was independent of the entrapment of argon gas during the HIP treatment. These cracks are generally subsurface, and may significantly decrease the life of welded components; as a result, they are undesired. A detailed analysis of the relation between Laves phase and HAZ microcracking is presented in Vincent, "Precipitation Around Welds In the Nickel Base Superalloy Inconel 718", Acta Metallurgica, Vol. 33, No. 7 (1985) pp. 1205–1216.

It has been determined that cast IN718 which contains Laves phase may be heat treated so as to dissolve substantially all of the Laves phase prior to HIP processing. See the copending and commonly assigned application, PRE-HIP HEAT TREATMENT OF SUPERALLOY CASTINGS, U.S. Ser. No. 565,589. The heat treatment renders the alloy more easily weldable: due to the absence of Laves phase, gas entrapment during HIP is substantially eliminated. However, this heat treatment is time-consuming, and best avoided if possible.

In a program which led to the development of the alloys of the present invention, metallographic examination was conducted to determine if there was a relationship between the quantity of Laves phase precipitate which formed in cast IN718 and the specimen solidification rate. The term "solidification rate" is meant to describe the rate of cooling between the alloy's solidus and liquidus temperatures. This examination revealed that the amount of Laves phase precipitate in as-cast specimens increased with decreasing (i.e., slower) solidification rates. This may be better seen by reference to FIGS. 3, 4, and 5. FIG. 3 is a photomicrograph of an IN718 test specimen solidified at a rate of about 5° F. per minute; it should be noted that at this relatively slow solidification rate, there is a substantial amount of Laves phase in the microstructure, in the form of an interconnected network of precipitate in interdendritic regions. FIG. 4 is a photomicrograph of an IN718 test specimen solidified at a rate of about 150° F. per minute. At this relatively fast cooling rate, the amount of Laves phase is considerably decreased compared to FIG. 3. Also, the Laves phase is present as isolated pools of precipitate, as compared to the interconnected network of FIG. 3. It should be apparent that if the interconnected Laves network of FIG. 3 melts during HIP, a substantially greater amount of gaseous HIP media may become entrapped in the alloy as compared to the amount entrapped if the Laves phase in FIG. 4 melts. FIG. 5 shows that the amount of Laves phase precipitate in cast IN718 is inversely proportional to the solidification rate of the alloy, i.e., more Laves phase forms as the solidification rate decreases. In the Figure, "Area Percent Laves Phase" was determined by optical microscopy at a magnification of 100×. The specimens shown in FIGS. 3 and 4 were prepared using standard metallographic techniques. To highlight the Laves phase precipitate, the specimens were electrolytically etched with an aqueous solution containing 10% oxalic acid. In these photomicrographs, the Laves phase appears as the white phase while the dark phase surrounding the Laves is predominantly the gamma double prime phase, $Ni_3Cb$. The gamma double prime phase is the primary strengthening phase in IN718; as such, the alloy, as well as those compositionally similar to it, are referred to as gamma double prime strengthened alloys. The matrix phase in IN718 is a nickel solid solution, gamma. Dispersed within the gamma phase are carbides, which also appear white in the photomicrographs. micrographs.

Laboratory and metallographic analysis of the Laves phase in IN718 revealed that it had a melting point of about 2,100°–2,125° F. This is considerably less than the IN718 solidus and liquidus temperatures, which are about 2,325° F. and 2,510° F., respectively, when Laves phase is not present. It is also less than a commonly used HIP temperature of 2,175° F., which accounts for the observed Laves phase melting during the HIP treatment, as discussed above. The Laves phase hardness was determined to be about 60 Rockwell C. Electron microprobe microanalysis of the Laves phase indicated that its composition was, on a weight percent basis, about 35–40 Ni, 25–30 Cb, 11–13 Fe, 11–13 Cr, 7–10 Mo, 1–2 Ti, 1 Si; this composition is in agreement with the composition reported in the above-mentioned articles by Vincent. U.S. Pat. No. 4,431,443 states, however, that in IN718, Laves phase is stoichiometrically written as $Ni_2Cb$, i.e., its composition is, by weight percent, 56 Ni–44 Cb.

In accordance with the trend shown in FIG. 5, it was found that in large, complex IN718 castings such as gas turbine engine diffuser cases, Laves phase was present in thick sections, and in other sections which due to inherent requirements of the casting operation (e.g., mold design, core placement, etc.) solidified at slow rates. For some currently used jet engines, as-cast diffuser cases may weigh up to about 1,000 pounds, and have section thicknesses which range between about 0.75 inch and 0.10 inch. In some thick sections, the solidification rate is estimated to be about 5° F. per minute; in some thin sections, the solidification rate is estimated to be about 150° F. per minute. Referring to FIG. 5, if IN718 is cast under these kinds of conditions, Laves phase will form in slowly solidifying areas. As discussed above, the presence of Laves phase renders IN718 unweldable, i.e., there is an unacceptable amount of outgassing and weld splatter generated, and microcracks in the HAZ are formed.

In a related program, it was determined that the tensile properties of cast+HIP IN718 were reduced by the presence of Laves phase in the microstructure, compared to specimens whose microstructure contained little or no Laves phase. See Table II, which presents data for cast+HIP IN718 specimens which had a considerable amount of Laves phase in the microstructure, similar to the amount present in the specimen shown in FIG. 3. Table II also presents data for cast+HIP IN718 specimens containing no Laves phase. These Laves free IN718 specimens were given a heat treatment prior to HIP processing which dissolved all of the Laves phase detectable at 100X resolution. This heat treatment caused no other detectable microstructural or metallurgical changes in the material. The HIP treatment for all specimens in the Table was 2,125° F. for 3 hours at 15,000 psi. Subsequent to the HIP treatment, all specimens were given a stabilization heat treatment at 1,600° F. for 10 hours, a solution heat treatment at 1,750° F. for 1 hour and a precipitation heat treatment at 1,350° F. for 8 hours, followed by a furnace cool at a rate of at least 100° F. per hour to 1,225° F., and holding at 1,225° F. for 8 hours. As is seen in the Table, the presence of Laves phase causes a debit in properties at both test temperatures. Ductility (i.e., reduction in area and elongation) and stress rupture are significantly reduced.

The alloys of the present invention result from an extensive program to develop alloys which have properties comparable to similarly processed IN718, and which can be cast into large, complex, and near-net shapes, have a microstructure characterized by little or no Laves phase or entrapped gas in the cast+HIP condition, and which can be welded to repair as-cast defects such as porosity or inclusions without outgassing or the generation of weld splatter, and without forming weld cracks.

DISCLOSURE OF THE INVENTION

The alloys of the present invention are modifications of the alloy IN718. In order to limit the amount of Laves phase which forms during solidification of these modified alloys, the chromium content is reduced to between about 10 and 15 weight percent. Laboratory tests have shown that the low Cr content effectively suppresses the formation of Laves phase during the solidification of the cast component, even at very slow solidification rates. Consequently, there is no melting along the interdendritic regions during the HIP treatment, and no entrapment of gaseous HIP media in the article. Any minute amounts of Laves phase which may form during solidification of the alloy are readily dissolved during a post-casting HIP treatment, so that in the cast+HIP condition, the microstructure contains no Laves phase and no entrapped gas. When subseguently heat treated, cast+HIP articles have mechanical properties comparable to similarly processed IN718, and are significantly more weldable than similarly processed IN718.

In these alloys, the molybdenum content may optionally be decreased to between zero and 3.3 weight percent. Molybdenum also influences the amount of Laves phase which forms in the cast microstructure, but not to the extent that Cr does. The composition range for the invention alloys is, by weight precent, 10–15 Cr, 0–3.3 Mo, 0.65–1.25 Ti, 4.75–5.5 Cb+Ta, 15–24 Fe, 0.2–0.8 Al, with the balance Ni+Co.

The foregoing and other features and advantages of the present invention will become more apparent in the light of the following detailed description of the preferred embodiments thereof as illustrated in the accompanying drawing.

BRIEF DESCRIPTION OF THE DRAWINGS

FIG. 3 is a photomicrograph (100×) of IN718 solidified at about 5° F. per minute, showing Laves phase precipitate.

FIG. 4 is a photomicrograph (100×) of IN718 solidified at about 150° F. per minute, showing Laves phase precipitate;

FIGS. **7*a* and 7*b* are photomicrographs (250×) of alloy LF1 and IN718 specimens, respectively.

BEST MODE FOR CARRYING OUT THE INVENTION

From the discussion in the Background Art section above, it is apparent that when IN718 is cast such that it solidifies at a slow rate, substantial quantities of Laves phase forms, weldability is adversely affected, and mechanical properties are decreased. These deficiencies point towards the need for an alloy composition which would have an as-cast microstructure which was substantially free of Laves phase precipitate even after slow rate solidification; such an alloy would not suffer from entrapment of the high pressure gas during the HIP treatment, nor would it suffer from HAZ microcracking. An additional requirement was that cast+HIP+heat treated articles have tensile properties comparable to similarly processed IN718 which had a Laves free microstructure, e.g., cast IN718 processed according to previously mentioned U.S. Ser. No. 565,589.

Wrought IN718 components do not likely suffer from property and processing degradation associated with the presence of as-cast Laves phase, because during the component's high temperature mechanical working, any Laves phase which may have formed during the solidification of the starting ingot will be broken up and dissolved. As a result of the wrought product's reduced segregation as well as reduced grain size, mechanical properties of wrought IN718 are better than cast materials, as are wrought alloys having compositions similar to IN718, some of which are described in U.S. Pat. Nos. 3,046,108, 3,758,295, and 4,231,795. However, these alloys depend on thermo-mechanical working to achieve their desired properties. See, e.g., the discussion in the '108 patent at column 3 starting at line 31. In the non-wrought condition, these prior art alloys may not be as useful.

In order to identify an alloy composition which was free from Laves phase precipitate in the as-cast condition, a laboratory test program was conducted to determine the effect of various elements on the formation of Laves phase during slow rate solidification. The first phase of the program investigated whether a composition still within the broad IN718 range could produce a substantially Laves free microstructure. The specific compositions evaluated in this phase of the program are presented in Table III. The solidification rate for these specimens was quite slow, about 5° F. per minute, which represented a rate typical of thick sections in large structural castings.

Figure 1:
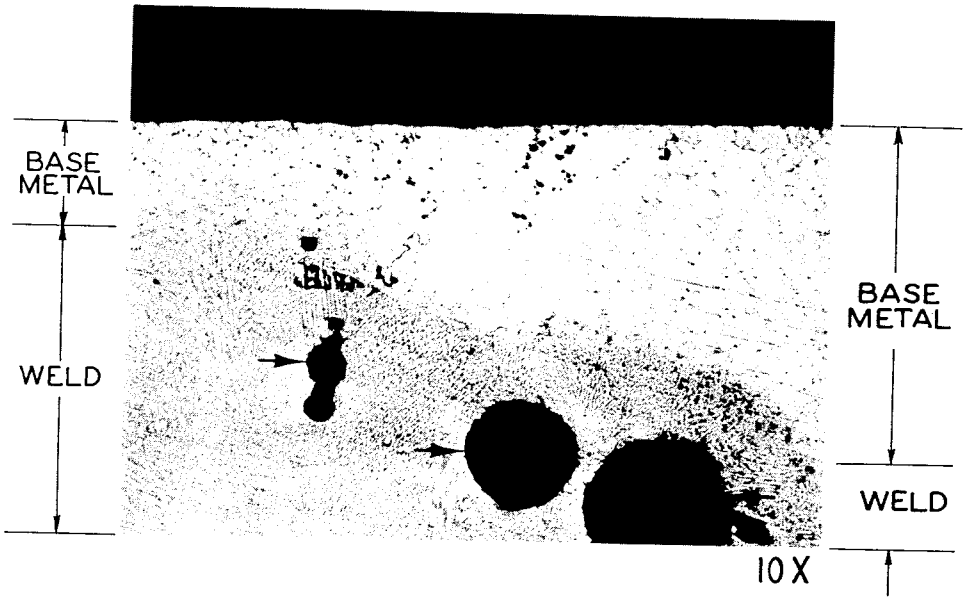
FIG. 1 is a photomicrograph (10×) showing gas holes in a weld on an IN718 test specimen.
Figure 2:
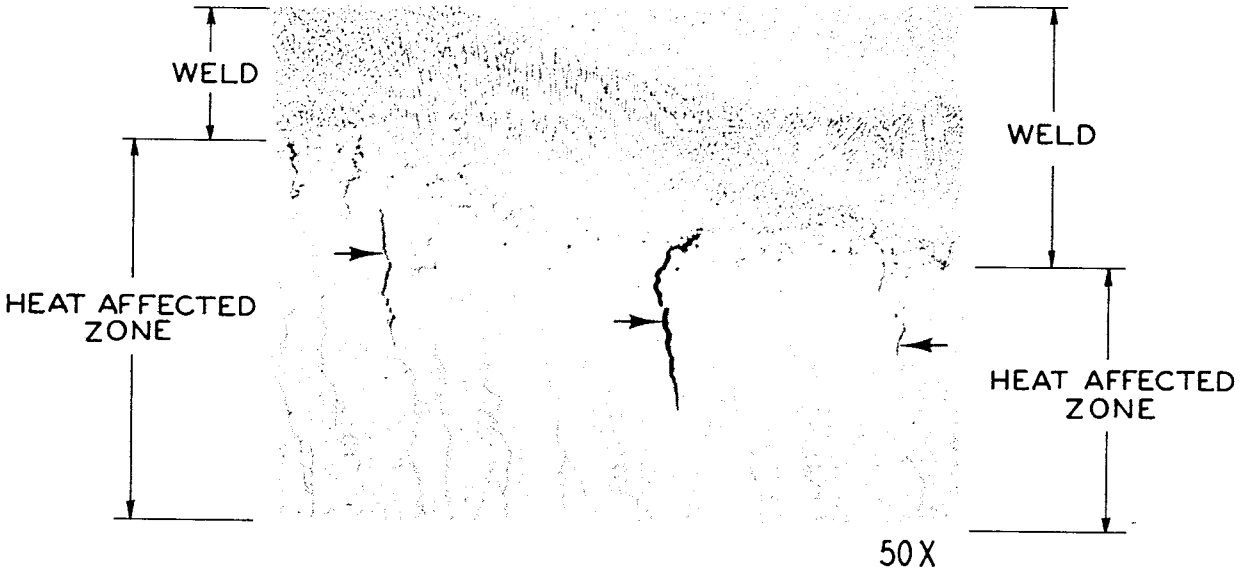
FIG. 2 is a photomicrograph (50×) showing HAZ microcracks in a weld on an IN718 test specimen.
Figure 5:
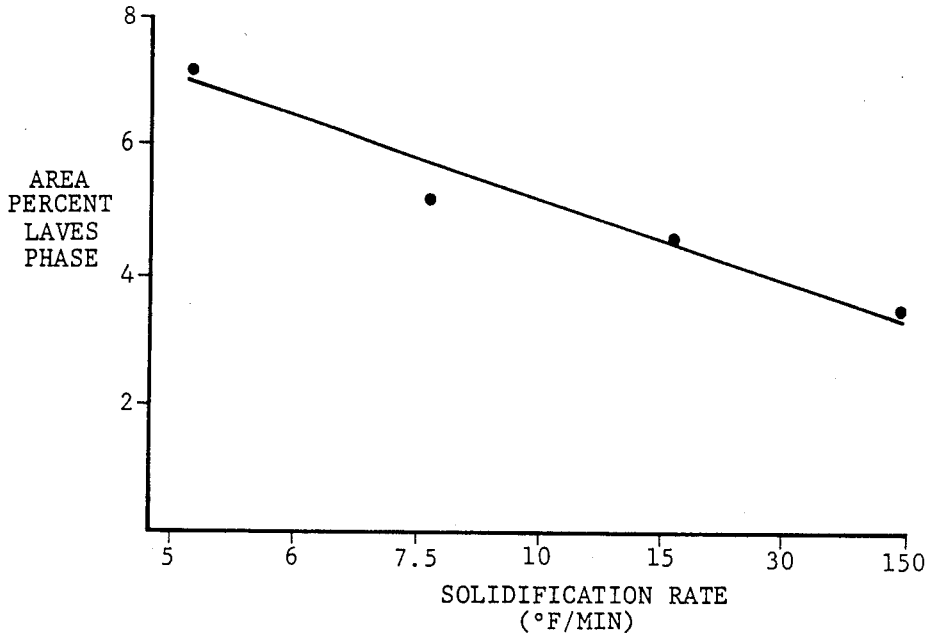
FIG. 5 shows the relationship between Laves phase formation in IN718 and solidification rates.

As is seen in Table III, the composition range for IN718 is presented as well as is a typical IN718 composition (alloy SS9). The amount of Laves phase in the microstructure was determined by optical measurements similar to those which produced the data in FIG. 5. In the Table, a "Heavy" amount of Laves phase means a microstructure characterized by about 4–5 area percent Laves phase, such as shown in FIG. 3. As is seen in the Table, varying the Si, Cr, and Cb levels within the IN718 composition range did not result in any marked change in the as-cast Laves phase content.

Figure 6:
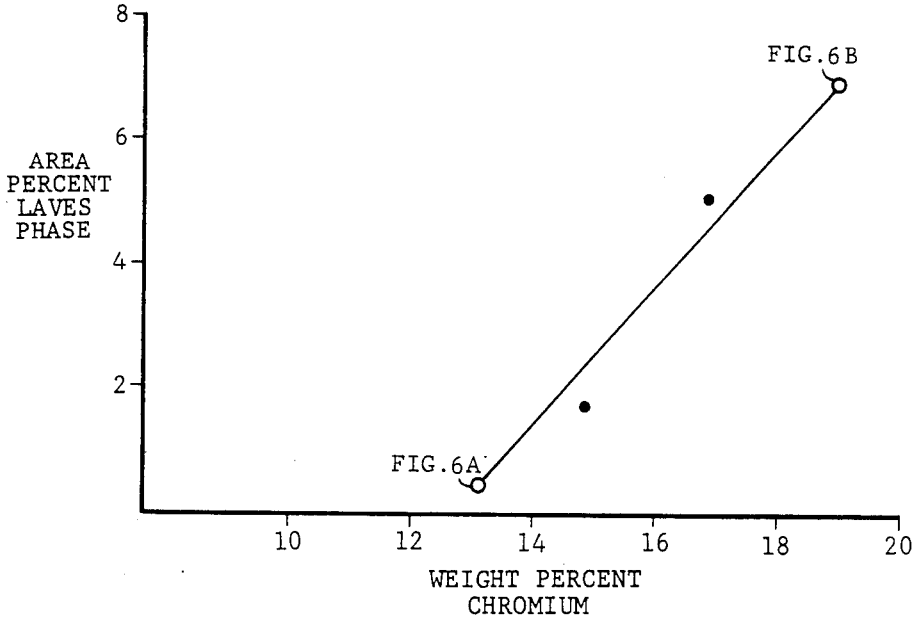
FIGS. 6, **6*a* and 6*b*** show the relationship between Laves phase formation and chromium content in the invention alloys and in IN718.
Figure 6B:
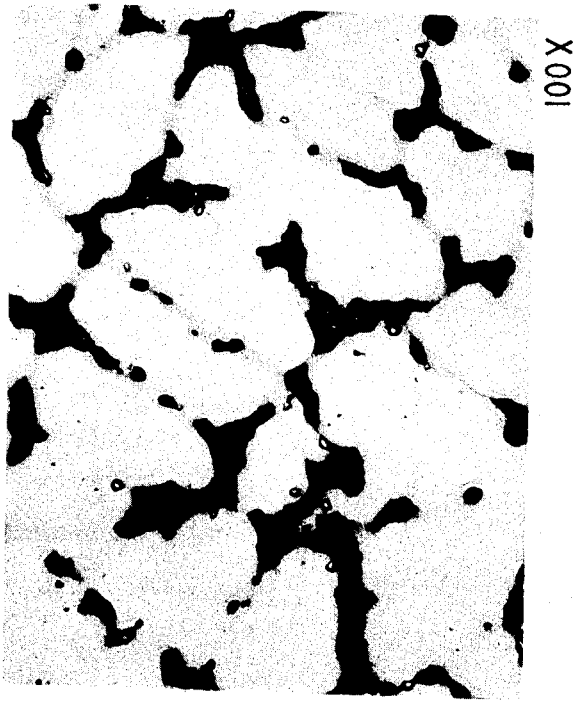
Figure 6A:
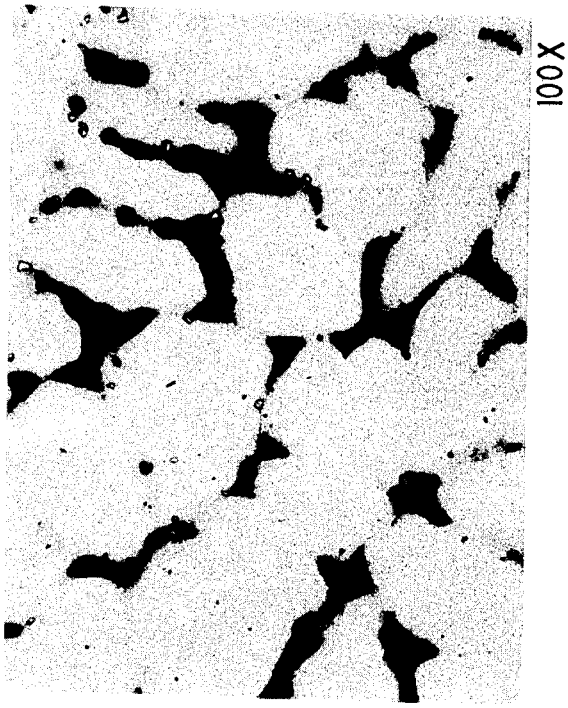

Tests were then conducted to determine the effect of lower Cr contents on Laves phase formation i.e., lower Cr contents than permitted by the IN718 range. Alloys containing 13 and 15 weight percent Cr were evaluated. The other elements remained at the levels indicated for alloy SS9 (Table III), the nominal IN718 composition. These tests revealed that, even for a slow solidification rate, the formation of Laves phase was significantly dependent upon the Cr content in the alloy, as shown in FIGS. 6, **6*a*, and 6*b*. Note that in FIG. 6, data points are denoted 6*a* and 6*b*. Photomicrographs of the specimens which correspond to these data points are shown in FIGS. 6*a* and 6*b***, respectively. That reduction in Cr content would reduce the Laves phase was surprising, since microprobe analysis determined that, other than Ni, the primary element in Laves phase is Cb, as discussed above. It was also surprising in view of the above referenced U.S. Pat. No. 4,431,443 which states that Laves phase is $Ni_2Cb$.

Additional tests indicated that reducing the Mo content from 3% to 1% also reduced the amount of as-cast Laves phase in an alloy which contained 13% Cr, although the effect on Laves phase formation of reducing the Mo content from 3% to 1% was not as dramatic as the effect of reducing the Cr content below the nominal 19%.

To evaluate the microstructure and mechanical properties of low Cr alloys, four 250 pound vacuum induction melted (VIM) heats of material were prepared. The actual chemistries for these heats, which are designated LF1a, LF1b, LF2a, and LF2b in Table IV are also given in the Table. Because of the similarity in chemistry of the heats LF1a and LF1b, they will hereinafter be collectively referred to as LF1. Also, because of the similarity in chemistry of the heats LF2a and LF2b, they will hereinafter be collectively referred to as LF2.

As seen in the Table, both alloy heats (LF1 and LF2) contained about 12% Cr; alloy LF1 contained about 3% Mo while alloy LF2 contained about 1% Mo. Otherwise, the composition of both alloys was similar to a typical IN718 composition, except for the fact that in these modified alloys, the Fe content was fixed at about 18; in IN718, Fe is the "balance" element. Limits on elements which are typically present as impurities in these types of alloys are also given in the Table.

To characterize these low Cr alloys, and compare them to IN718, two different engine components having alloy LF1, LF2, and IN718 chemistries were investment cast under substantially identical conditions, using techniques well known in the art. In gas turbine engines in use today, these particular engine components are currently both cast IN718. One component was about 15 inches in diameter, and weighed about 15 pounds. The second component was about 34 inches in diameter, and weighed about 30 pounds. Metallographic examination of each component in the as-cast condition (FIGS. *7a* and *7b*) revealed virtually no Laves phase in alloys LF1 and LF2, while IN718 specimens contained moderate quantities of Laves phase. Laves phase in IN718 is shown by arrows in FIG. *7b*. This quantity was significantly less than the quantity typically observed in slow cooled areas of large, complex castings. Also, the Laves phase did not have the interconnected nature shown in FIG. 3. Nonetheless, it was quite apparent that the modified alloys containing about 12% chromium had a lower propensity for the formation of Laves phase during solidification than the IN718 composition.

To evaluate the mechanical properties of the low Cr alloys LF1 and LF2 relative to IN718, specimens were tested in the HIP+heat treated condition. The HIP treatment was 2,175° F. for 4 hours at 15,000 psi. To evaluate the effect of different heat treatment conditions on the tensile properties of alloys LF1 and LF2, two different heat treatment schedules were used. In Tables V–VI, which present the results of tensile testing at 70° and 1,200° F., respectively, the heat treatment designated "1" comprised a stabilization treatment at 1,600° F. for 10 hours, a solution treatment at 1,750° F. for 1 hour, and a precipitation (aging) treatment at 1,350° F. for 8 hours, followed by a furnace cool at a rate of at least 100° F. per hour to 1,225° F., holding at 1,225° F. for 8 hours, and the cooling to room temperature. The heat treatment designated "2" in the Tables comprised a stabilization treatment at 1,600° F. for 24 hours; the solution and aging treatments were the same as in heat treatment 1.

As is seen in the Tables, the low Cr alloys LF1 and LF2 have tensile properties which are generally comparable to cast+HIP+heat treated IN718 properties. While IN718 properties are slightly greater than alloy LF1 and LF2 properties at 70° F., this is felt to be of little practical significance. The higher test temperature (i.e., 1,200° F.) is representative of typical operating temperatures in the areas that components having this composition will likely be utilized. Thus, it is at this temperature that tensile properties of the low Cr alloys must be comparable to IN718; Table VI indicates that this requirement has been met.

Figure 8:
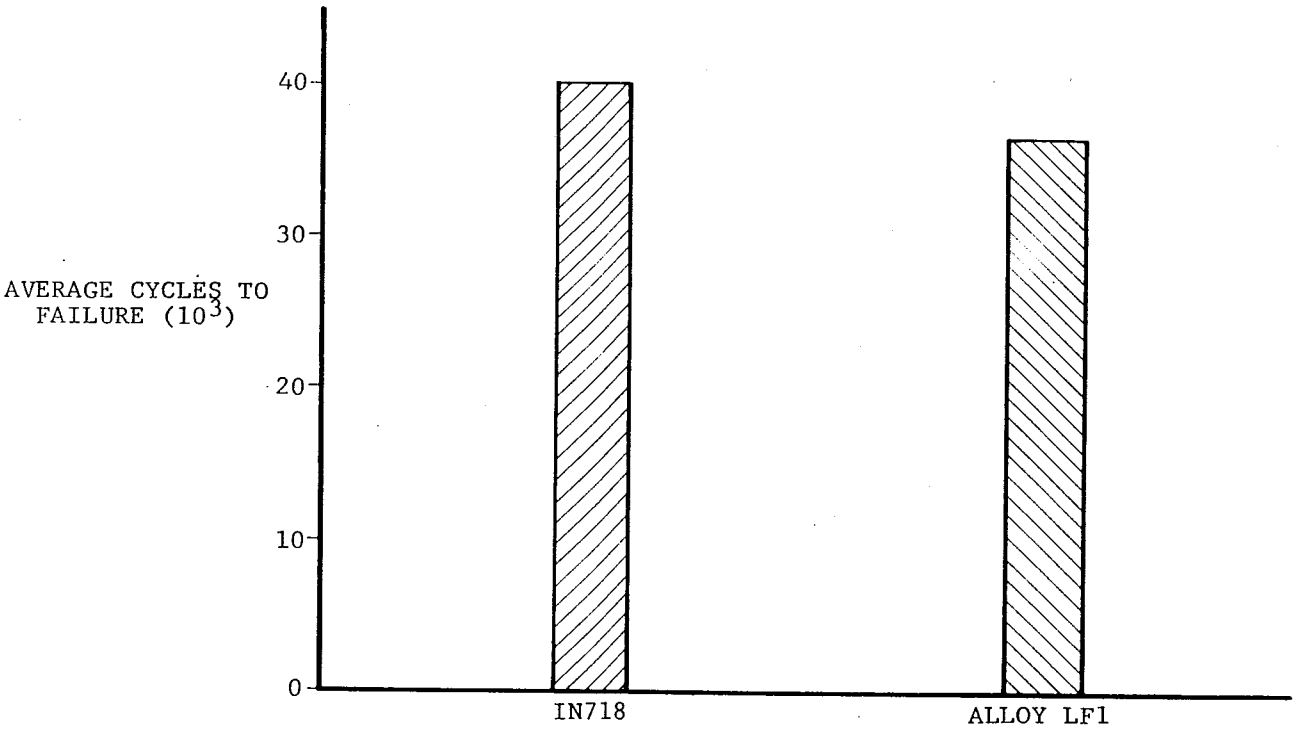
FIG. 8** is a graphical representation showing the comparative low cycle fatigue behavior of alloy LF1 and IN718 specimens.
Figure 7B:
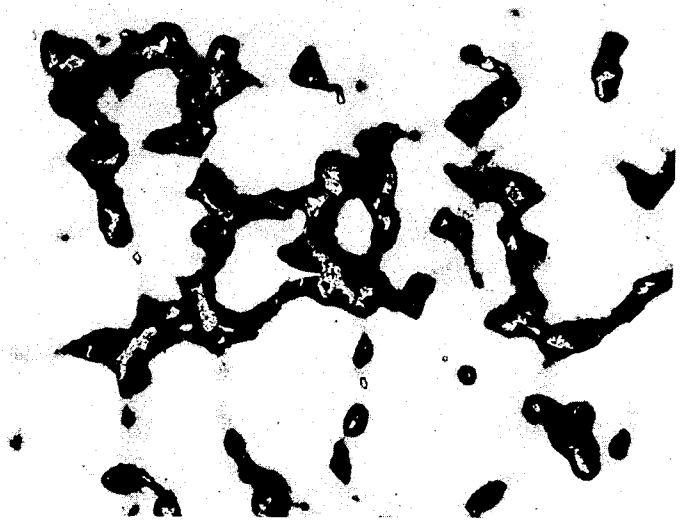
Figure 7A:
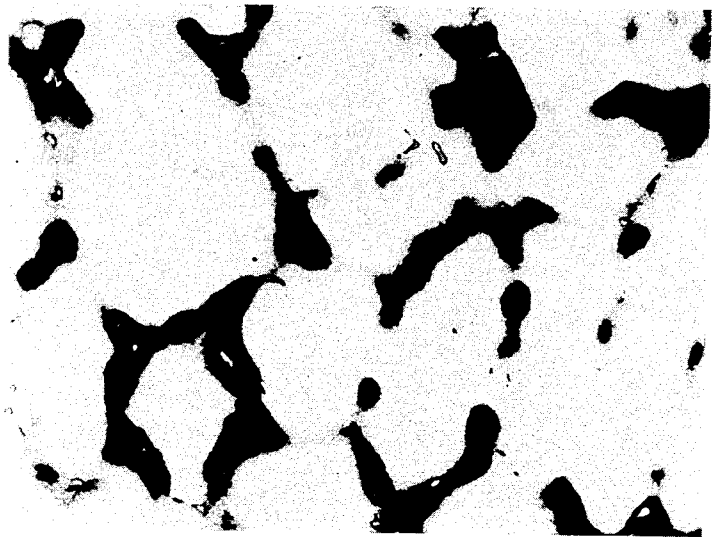

Isothermal low cycle fatigue (LCF) testing at 1,100° F. has been conducted on cast+HIP+heat treated alloy LF1 and IN718 specimens. Averaged, preliminary test results, shown in FIG. 8, indicate that alloy LF1 specimens have LCF properties which are comparable to IN718 specimens.

The modified alloys were found to have the same castability as IN718. "Castability" is a measure of the capability of an alloy to fill a mold and solidify without the formation of hot tears or excessive shrinkage porosity. Tests have shown that the low Cr alloys LF1 and LF2, as well as IN718, successfully filled their molds, and the resultant castings contained a comparable number of surface and subsurface defects. Thus, it was concluded that all three alloys had comparable castability.

Because large, complex castings may contain as-cast defects, they must be weldable to repair such defects. Because little or no Laves phase has been observed in small castings of alloys LF1 and LF2, while IN718 castings did contain Laves phase, these low Cr alloys will not suffer from Laves phase formation even when solidified at slow rates, and consequently, will not suffer from an unacceptable degree of outgassing, weld splatter, or HAZ microcracking when welded; thus, these alloys are considered weldable. In fact, tests have shown that the alloys of the invention are more weldable than standard IN718.

Large structural castings having a composition within the range specified in Table IV may be produced using casting techniques known in the art. A preferred method is to melt virgin stock by vacuum induction melting (VIM) and to solidify the molten metal in an investment casting mold. While the use of virgin stock is preferred, it is believed that revert, or scrap, material may also be used.

To close non-surface connected porosity, and to dissolve any small quantities of Laves phase which may form in the casting, the component is preferably HIP'd after casting. One HIP treatment which has yielded favorable reduction in porosity, as well as dissolution of Laves phase, is 2,175° F. for 4 hours at 15,000 psi. However, those skilled in the art will recognize that other temperature, time, and pressure combinations may yield equally favorable results. Since Laves phase is dissolved into the gamma matrix during the elevated temperature HIP treatment, it is not necessary that the as-cast microstructure be entirely free of Laves phase precipitate. Rather, the as-cast microstructure need only be substantially free from relatively continuous Laves phase, i.e., may contain a small amount of Laves phase, less than about 2 area percent.

If any surface defects such as porosity or inclusions are found in the casting after HIP'ing, such defects may be removed by e.g., abrasive grinding. These areas may then be weld repaired, preferably using weld filler metal (e.g., rod or wire) which has a composition within the range specified in Table IV. This particular composition is used in order to avoid any incompatibilities between the weld bead and base metal. Prior to welding, the component is preferably heat treated as follows: 1,600°±25° F./10–24 hours (air cool), followed by 1,750°±25° F./1 hour (air cool). Following weld repair, the component is reinspected to determine the effectiveness of the welding operation. If no further defects are found, the component is further heat treated as follows: 1,750° F.±25° F./1 hr (air cool), followed by 1,350°±25° F./8 hours (furnace cool to 1,225° F.), followed by 1,225°±25° F./8 hours (air cool). Such a heat treatment optimizes the alloy mechanical properties.

Defects other than those produced in the casting process, e.g., due to handling, service operation, etc., are weld repaired in the same manner as described above.

Although the invention has been shown and described with respect to a prefered embodiment thereof, it should be understood by those skilled in the art that other various changes and omissions in the form and detail thereof may be made therein without departing from the spirit and scope of the invention.

TABLE I

AVERAGE IN718 TENSILE PROPERTIES AT 1,200° F.

| Property | Wrought | Cast + HIP |
|---|---|---|
| 0.2% yield strength ($10^3$ psi) | 135 | 105 |
| Ultimate Tensile Strength ($10^3$ psi) | 155 | 110 |
| Reduction in Area (%) | 35 | 20 |
| Elongation (%) | 20 | 10 |

TABLE II

EFFECT OF LAVES PHASE ON 70° F. AND 1,200° F. TENSILE AND STRESS RUPTURE PROPERTIES OF CAST + HIP + HEAT TREATED IN718

| | Laves Phases In Microstructure | | Laves Free Microstructure* | |
|---|---|---|---|---|
| Property | 70° F. | 1,200° F. | 70° F. | 1,200° F. |
| 0.2% Yield Strength ($10^3$ psi) | 104 | 87 | 113 | 93 |
| Ultimate Tensile Strength ($10^3$ psi) | 114 | 95 | 121 | 101 |
| Reduction In Area (%) | 12 | 12 | 26 | 24 |
| Elongation (%) | 4 | 4 | 7 | 7 |
| Stress Rupture (hours at 90 × $10^3$ psi) | — | 8.85 | — | 56 |

*Specimens given a pre-HIP treatment to dissolve substantially all of the as-cast Laves phase precipitate.

TABLE III

Laves Phase In As-Cast Microstructure For Alloys Within IN718 Range (5° F./min Solidification Rate)

| Alloy | Si | Cr | Cb | Mo | C | Ti | Al | Fe | Ni | Amount of Laves |
|---|---|---|---|---|---|---|---|---|---|---|
| IN718 range | 0.35 max | 17–21 | 4.75–5.5 | 2.8–3.3 | 0.08 max | 0.65–1.15 | 0.2–0.8 | Balance | 50–55 | — |
| SS9* | 0.10 | 19.0 | 5.1 | 3.0 | 0.04 | 1.0 | 0.5 | 18.0 | Balance | Heavy** |
| SS1 | 0.10 | 17.0 | 4.75 | 3.0 | 0.04 | 1.0 | 0.5 | 18.0 | Balance | Heavy |
| SS2 | 0.10 | 17.0 | 5.50 | 3.0 | 0.04 | 1.0 | 0.5 | 18.0 | Balance | Heavy |
| SS3 | 0.10 | 21.0 | 4.75 | 3.0 | 0.04 | 1.0 | 0.5 | 18.0 | Balance | Heavy |
| SS4 | 0.10 | 21.0 | 5.50 | 3.0 | 0.04 | 1.0 | 0.5 | 18.0 | Balance | Heavy |
| SS5 | 0.35 | 17.0 | 4.75 | 3.0 | 0.04 | 1.0 | 0.5 | 18.0 | Balance | Heavy |
| SS6 | 0.35 | 17.0 | 5.50 | 3.0 | 0.04 | 1.0 | 0.5 | 18.0 | Balance | Heavy |
| SS7 | 0.35 | 21.0 | 4.75 | 3.0 | 0.04 | 1.0 | 0.5 | 18.0 | Balance | Heavy |
| SS8 | 0.35 | 21.0 | 5.50 | 3.0 | 0.04 | 1.0 | 0.5 | 18.0 | Balance | Heavy |
| SS10 | 0.10 | 17.0 | 5.1 | 3.0 | 0.04 | 1.0 | 0.5 | 18.0 | Balance | Heavy |

*Typical IN718 composition.

**A "Heavy" amount of Laves Phase precipitate is shown in FIG. 3.

TABLE IV

LAVES FREE ALLOY COMPOSITIONS

| Element | Composition Range | Alloy LF1a | Alloy LF1b | Alloy LF2a | Alloy LF2b |
|---|---|---|---|---|---|
| Cb + Ta | 4.75–5.50 | 4.78 | 4.85 | 5.07 | 5.08 |
| Ti | 0.65–1.25 | 0.99 | 0.99 | 1.02 | 1.02 |
| Cr | 10.0–15.0 | 11.9 | 12.0 | 11.8 | 11.8 |
| Mo | 0.0–3.30 | 2.96 | 2.96 | 1.10 | 1.11 |
| Fe | 15.0–24.0 | 18.6 | 18.5 | 18.2 | 18.2 |
| Al | 0.20–0.80 | 0.50 | 0.50 | 0.51 | 0.45 |
| Ni + Co | Balance | Balance | Balance | Balance | Balance |
| Co | 0.0–1.00 | <0.10 | <0.10 | <0.10 | <0.10 |
| C | 0.0–0.08 | 0.04 | 0.04 | 0.04 | 0.04 |
| Mn | 0.0–0.35 | 0.02 | 0.02 | 0.02 | 0.02 |
| Si | 0.0–0.35 | 0.02 | 0.03 | 0.03 | 0.02 |
| P | 0.0–0.015 | <0.01 | <0.01 | <0.01 | <0.01 |
| S | 0.0–0.015 | 0.002 | 0.002 | 0.004 | 0.003 |
| B | 0.0–0.006 | 0.002 | 0.002 | 0.003 | 0.002 |
| Cu | 0.0–0.10 | <0.10 | <0.10 | <0.10 | <0.10 |
| Zr | 0.0–0.05 | <0.05 | <0.05 | <0.05 | <0.05 |
| Pb | 0.0–0.0010 | <0.001 | <0.001 | <0.001 | <0.001 |
| Bi | 0.0–0.00005 | <0.00005 | <0.00005 | <0.00005 | <0.00005 |
| Se | 0.0–0.0003 | <0.0003 | <0.0003 | <0.0003 | <0.0003 |

TABLE V

ALLOY TENSILE PROPERTIES AT 70° F.; SPECIMENS REMOVED FROM CAST + HIP + HEAT TREATED ENGINE COMPONENTS

| Alloy | Heat Treatment | 0.2% Yield Strength ($10^3$ psi) | Ultimate Tensile ($10^3$ psi) | Elongation (%) | Reduction In Area (%) |
|---|---|---|---|---|---|
| IN718 | 1 | 124.9 | 138.3 | 11.3 | 25.9 |
| IN718 | 1 | 132.9 | 147.6 | 14.9 | 25.6 |
| IN718 | 1 | 138.4 | 149.1 | 8.4 | 11.7 |
| IN718 | 1 | 138.6 | 149.3 | 7.5 | 12.4 |
| LF1 | 1 | 111.2 | 129.4 | 16.3 | 23.0 |
| LF1 | 1 | 123.3 | 146.5 | 18.6 | 21.0 |
| LF1 | 2 | 120.7 | 138.4 | 12.0 | 19.1 |
| LF1 | 2 | 112.9 | 139.0 | 14.0 | 16.1 |
| LF2 | 1 | 124.9 | 144.7 | 15.8 | 23.5 |
| LF2 | 1 | 127.5 | 147.4 | 15.2 | 25.3 |
| LF2 | 2 | 133.5 | 150.8 | 12.8 | 16.2 |
| LF2 | 2 | 128.4 | 147.1 | 13.8 | 16.8 |

TABLE VI

ALLOY TENSILE PROPERTIES AT 1,200° F.; SPECIMENS REMOVED FROM CAST + HIP + HEAT TREATED ENGINE COMPONENTS

| Engine Alloy | Heat Treatment | 0.2% Yield Strength ($10^3$ psi) | Ultimate Tensile Strength ($10^3$ psi) | Elongation (%) | Reduction In Area (%) |
|---|---|---|---|---|---|
| IN718 | 1 | 107.3 | 117.9 | 13.4 | 34.3 |
| IN718 | 1 | 99.0 | 107.3 | 14.6 | 29.3 |
| IN718 | 1 | 107.8 | 116.3 | 9.0 | 28.2 |
| IN718 | 1 | 105.6 | 116.7 | 8.0 | 22.8 |
| IN718 | 1 | 106.2 | 111.5 | 10.7 | 21.9 |
| IN718 | 1 | 103.1 | 112.5 | 12.0 | 28.9 |
| LF1 | 1 | 102.9 | 112.9 | 14.6 | 23.2 |
| LF1 | 1 | 99.8 | 110.0 | 17.2 | 22.6 |
| LF1 | 1 | 102.9 | 113.1 | 10.9 | 33.4 |
| LF1 | 1 | 102.0 | 109.4 | 12.3 | 33.4 |
| LF1 | 2 | 94.9 | 114.2 | 11.6 | 21.2 |
| LF1 | 2 | 101.5 | 115.1 | 12.5 | 17.8 |
| LF2 | 1 | 107.4 | 116.0 | 11.2 | 21.7 |
| LF2 | 1 | 95.0 | 103.9 | 12.4 | 31.1 |
| LF2 | 1 | 104.1 | 115.3 | 11.5 | 17.5 |
| LF2 | 1 | 104.1 | 112.2 | 9.3 | 26.7 |
| LF2 | 2 | 100.2 | 111.8 | 10.0 | 14.7 |
| LF2 | 2 | 107.2 | 107.1 | 10.0 | 21.8 |

We claim:

1. A non-wrought, weldable, nickel base superalloy article consisting essentially of, by weight percent, 10–15 Cr, 0–3.3 Mo, 0.65–1.25 Ti, 4.75–5.5 Cb+Ta, 15–24 Fe, 0.2–0.8 Al, with the balance Ni+Co, said article having a microstructure substantially free of entrapped argon gas and Laves phase precipitate after HIP'ing at conditions sufficient to close as-cast, non-surface connected porosity.

2. A method for producing an article of manufacture, comprising the steps of:

(a) providing an alloy consisting essentially of, by weight percent, 10–15 Cr, 0–3.3 Mo, 0.65–1.25 Ti, 4.75–5.5 Cb+Ta, 15–24 Fe, 0.2–0.8 Al, with the balance Ni+Co;

(b) melting and solidifying the alloy to form a cast article;

(c) HIP'ing the article at conditions sufficient to substantially close as-cast, non-surface connected porosity;

(d) heat treating the article at about 1,575° F.–1,625° F. for 10–24 hours followed by about 1,725°–1,775° F. for 1 hour;

(e) weld repairing as-cast defects; and (f) heat treating the article at about 1,725°–1,775° F. for 1 hour, followed by 1,325°–1,375° F. for 8 hours and cooling to between 1,200°–1,250° F. at a rate equal to or less than furnace cool, holding at about 1,200°–1,250° F. for 8 hours followed by an air cool to room temperature.

3. The method of claim 2, wherein the weld filler metal used in said step of weld repairing consists essentially of, by weight percent, 10–15 Cr, 0–3.3 Mo, 0.65–1.25 Ti, 4.75–5.5 Cb+Ta, 15–24 Fe, 0.2–0.8 Al, with the balance Ni+Co.

4. A gas turbine engine component produced by the method of claim 3.

5. A method for making an article of manufacture, comprising the steps of:

(a) melting and solidifying an alloy which consists essentially of, by weight percent, 10–15 Cr, 0–3.3 Mo, 0.65–1.25 Ti, 4.75–5.5 Cb+Ta, 15–24 Fe, 0.2–0.8 Al, balance Ni+Co to form a cast article, the as-cast article microstructure being substantially free from Laves phase;

(b) HIP'ing the cast article at conditions sufficient to substantially close as-cast, non-surface connected porosity, wherein the microstructure of the HIP'd article is substantially free from Laves phase and entrapped HIP media; and (c) heat treating the article to optimize properties.

6. The method of claim 5, further comprising the step of welding the article to repair any defects therein, wherein no weld outgassing occurs due to the freedom from Laves phase.

7. The article formed by the method of claim 5.

8. The article formed by the method of claim 6.

9. An oxidation resistant welded article substantially free from Laves phase and weld cracks, consisting essentially of, by weight percent, 10–15 Cr, 0.3–3 Mo, 0.65–1.2 Ti, 4.75–5.5 Cb+Ta, 15–24 Fe, 0.2–0.8 Al, balance Ni+Co.

* * * * *